United States Patent [19]

Schwartz et al.

[11] Patent Number: 4,664,617

[45] Date of Patent: May 12, 1987

[54] METHOD AND BURNER APPARATUS FOR FLARING INERT VITIATED WASTE GASES

[75] Inventors: Robert E. Schwartz; Roger K. Noble, both of Tulsa, Okla.

[73] Assignee: John Zink Company, Tulsa, Okla.

[21] Appl. No.: 802,692

[22] Filed: Nov. 26, 1985

[51] Int. Cl.[4] ..... F23D 13/20

[52] U.S. Cl. ..... 431/8; 431/202; 431/284

[58] Field of Search ..... 431/202, 284, 8

[56] References Cited

U.S. PATENT DOCUMENTS

| | | | |
|---|---|---|---|
| 3,730,673 | 5/1973 | Straitz, III | 431/278 |
| 4,140,471 | 2/1979 | Straitz et al. | 431/202 |
| 4,347,052 | 8/1982 | Reed et al. | 431/284 |
| 4,457,696 | 7/1984 | Schwartz et al. | 431/350 |
| 4,538,982 | 9/1985 | McGill et al. | 431/202 |

FOREIGN PATENT DOCUMENTS

| | | | |
|---|---|---|---|
| 2021253 | 11/1979 | United Kingdom | 431/202 |

OTHER PUBLICATIONS

John Zink Company advertising brochure entitled "Offshore Flaring Systems, Flare Division" (Brochure 5431), published 1981, 4 pages.

*Primary Examiner*—Carroll B. Dority, Jr.

*Attorney, Agent, or Firm*—Laney, Dougherty, Hessin & Beavers

[57] ABSTRACT

A method and flare burner apparatus for flaring inert vitiated waste gases in an efficient stable manner are provided. The apparatus is comprised of a first tubular member for discharging waste gases having an inlet end and a discharge end and a second tubular member positioned around at least the discharge end portion of the first tubular member whereby a discharge space is provided between the first and second tubular members around and adjacent the discharge end of the first tubular member. Burner means are disposed within the discharge space for discharging and igniting fuel gas therein and fuel gas conduit means are sealingly connected to the burner means for connecting the burner means to a source of fuel gas. Air conduit means are sealingly connected to the discharge space for connecting such space to a source of combustion air. Combustion air supplied to the discharge space is mixed with fuel gas supplied to and discharged from the burner means and the mixture is ignited and discharged from the discharge space and burned in a stable envelope around discharged waste gases. A portion of the waste gases are heated by the burning fuel gas and air, ignited and burned thereby providing a source of heat and ignition to the remaining gases which are burned in an efficient manner.

11 Claims, 12 Drawing Figures

METHOD AND BURNER APPARATUS FOR FLARING INERT VITIATED WASTE GASES

BACKGROUND OF THE INVENTION

1. Field of the Invention

The present invention relates generally to a method and flare burner apparatus for flaring gases, and more particularly, to a method and flare burner apparatus for flaring inert vitiated waste gases whereby such gases are burned in an efficient and stable manner.

2. Description of the Prior Art

Flare burner apparatus are common utilized for disposing of waste gases, both continuously and intermittently. Generally, such flare burners include continuously burning pilot flames for igniting and maintaining the burning of the waste gases.

When the flared waste gases contain inerts in high quantities i.e., the waste gases have heating values below about 300 BTU/SCF when burned, problems have been encountered in the use of prior flaring methods and burner apparatus. That is, the burning of such inert vitiated waste gases can be inefficient and/or unstable and in windy environments the flames can be blown out. Examples of particularly difficult inert vitiated waste gases are those containing high concentrations of carbon dioxide such as steel mill blast furnace residue gas and the gases produced in subterranean formation carbon dioxide secondary recovery processes.

Prior to the present invention inert vitiated waste gases have been flared in conventional flare burner apparatus by combining fuel gas with the waste gases to form a relatively high calorific value gas mixture and then conducting the high calorific value gas mixture to the burner apparatus. Because this technique requires high quantities of fuel gas and is expensive to carry out, special flare burner apparatus have been developed which burn a separate stream of a fuel and air mixture at the burner apparatus to heat a portion of the waste gases to the temperature required for ignition and burning thereof. While various forms of this type of flare burner apparatus have been developed and used successfully, they are generally limited in size and capacity because the quantity of the fuel and air mixture which can be economically provided at the flare burner apparatus is limited. That is, the higher the quantity of inert vitiated waste gases to be burned, the more auxiliary fuel and air mixture required and the more expensive the flare burner apparatus.

Other flare burner apparatus developed prior to the present invention for burning inert vitiated waste gases have included means for discharging auxiliary fuel gas into the atmosphere around and/or into the waste gases whereby the fuel gas mixes with atmospheric air, is ignited and burned thereby raising the temperature of a portion of the waste gases to the ignition temperature thereof. While this type of flare burner can be used successfully, the burning of the fuel gas and waste gases using such a burner in a windy environment may sometimes result in an unstable and/or inefficient burning.

A variety of air assisted flare burner apparatus wherein combustion air is forced through or around the burner by one or more air blowers have been developed and used in the flaring of combustible gases. However, such forced draft burners are ineffective for flaring inert vitiated waste gases in that the gases are diluted and cooled by the air and consequently, do not reach the temperature at which ignition will occur. A large capacity air powered smokeless flare of this type is described in U.S. Pat. No. 4,457,696 issued July 3, 1984.

Thus, there is a need for a method and burner apparatus for flaring inert vitiated waste gases whereby the gases can be efficiently burned in a stable manner in windy environments and whereby high flow rates of such waste gases can be flared.

SUMMARY OF THE INVENTION

A flare burner apparatus for flaring inert vitiated waste gases comprised of a first tubular member for discharging waste gases having an inlet end and a discharge end, a second tubular member positioned around at least the discharge end portion of the first tubular member whereby a discharge space is provided between the first and second tubular members around and adjacent the discharge end of the first tubular member and burner means disposed within the discharge space for discharging and igniting fuel gas therein. Fuel gas conduit means are sealingly connected to the burner means for connecting the burner means to a source of fuel gas and combustion air conduit means are sealingly connected to the discharge space for connecting the space to a source of combustion air. Combustion air is supplied to the discharge space and mixed with fuel gas supplied to and discharged from the burner means therein, and the resulting mixture is ignited, discharged from the discharge space and burned in a stable envelope around waste gases discharged from the first tubular member. A portion of the waste gases are heated by the burning fuel gas and air to the ignition temperature thereof, ignited and burned thereby providing a source of heat and ignition to the remaining gases which are burned in an efficient manner. A method of flaring inert vitiated waste gases is also provided.

It is, therefore, a general object of the present invention to provide an improved method and flare burner apparatus for flaring inert vitiated waste gases.

A further object of the present invention is the provision of a method and apparatus for flaring inert vitiated waste gases in a stable and efficient manner, even in windy environments.

Another object of the present invention is the provision of a method and flare burner apparatus for economically flaring relatively high flow rates of inert vitiated waste gases.

Other and further objects, features and advantages of the present invention will be readily apparent to those skilled in the art upon a reading of the description of preferred embodiments which follows when taken in conjunction with the accompanying drawings.

DESCRIPTION OF THE PREFERRED EMBODIMENTS

Figure 1:
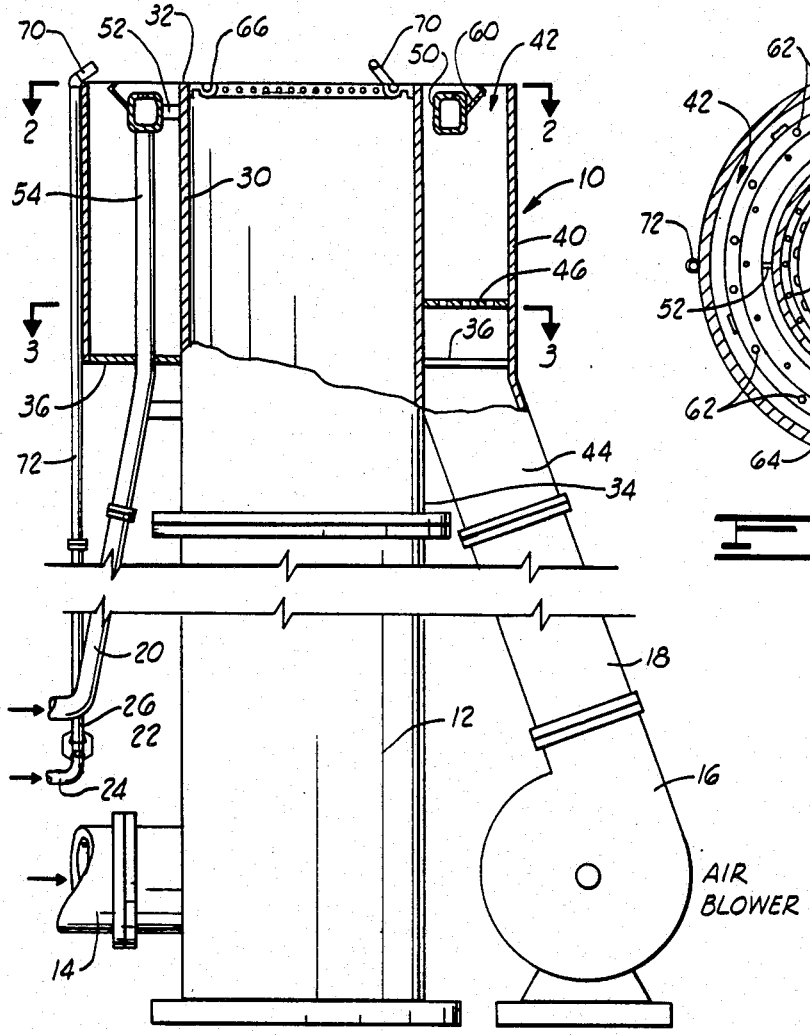
FIG. 1 is a side, partly sectional view of one form of flare burner apparatus of the present invention.

Referring now to the drawings, and particularly to FIGS. 1-5, flare burner apparatus of the present invention is illustrated and generally designated by the numeral 10. In FIG. 1, the flare burner apparatus 10 is shown connected to an upstanding waste gas stack or conduit 12 which is in turn connected to a conduit 14. The conduit 14 conducts a stream of waste gas from a source thereof to the conduit 12.

A combustion air blower 16 is connected to a conduit 44 of the apparatus 10 by a conduit 18 and burner fuel gas is connected to a conduit 54 of the apparatus 10 by a conduit 20. Pilot fuel gas is conducted to conventional gas-air mixers 22 by conduits 24 and the fuel and air mixtures produced in the mixers 22 are conducted to conduits 72 and pilot burner apparatus 70 of the apparatus 10 by conduits 26.

Figure 2:
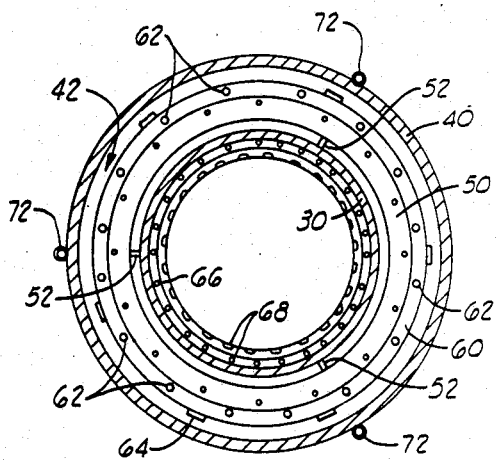
FIG. 2 is a cross-sectional view taken along line 2—2 of FIG. 1.
Figure 3:
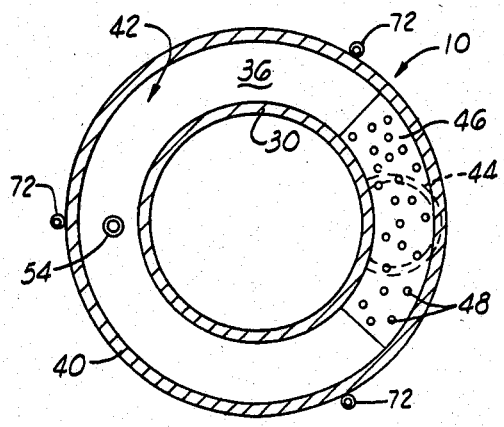
FIG. 3 is a cross-sectional view taken along line 3—3 of FIG. 1.

As best shown in FIGS. 1-3, the burner apparatus 10 is comprised of a first tubular member 30, preferably cylindrical, having a discharge end 32 and an inlet end 34. The inlet end 34 of the tubular member 30 includes a conventional flange which is connected to a complementary flange attached to the conduit 12. Positioned around at least the discharge end portion of the tubular member 30 and attached thereto by an annular closing wall 36 is a second tubular member 40, preferably also cylindrical in shape. The first and second tubular members 30 and 40 provide a discharge space 42 therebetween positioned around and adjacent the discharge end 32 of the first tubular member 30. While the discharge ends of the tubular members 30 and 40 are shown in the drawings to lie in the same plane, it is to be understood that the ends can be positioned at different elevations relative to each other.

A conduit 44 for conducting forced air is sealingly attached to the discharge space 42, i.e., the conduit 44 is sealingly attached to the wall 36 over an opening therein. The conduit 44 is in turn attached to the combustion air conduit 18 so that a stream of combustion air produced by the air blower 16 is conducted to the discharge space 42 and discharged therefrom around the discharge end 42 of the tubular member 30. Disposed within the annular discharge space 42 above the conduit 44 is a diverting plate 46. The diverting plate 46 can cover a 360° or less segment of the annular space 42 (a 90° segment plate being shown) and contains perforations of a number and size such that the stream of air conducted to the space 42 by the conduit 44 is distributed within the space 42 and the air is discharged therefrom in the form of an annular envelope of relatively constant velocity.

Located within the discharge space 42 is a burner 50. The burner 50 can take various forms including multiple burner tips or nozzles, but preferably is a continuous annular conduit of square, rectangular or round shape centered about the tubular member 30 by a plurality of lugs 52. A conduit 54 is sealingly connected to the burner 50 and to the burner fuel gas conduit 20 previously described.

Figure 4:
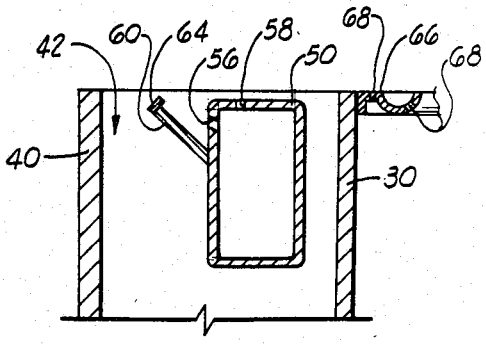
FIG. 4 is an enlarged view of a portion of the apparatus of FIG. 1.
Figure 5:
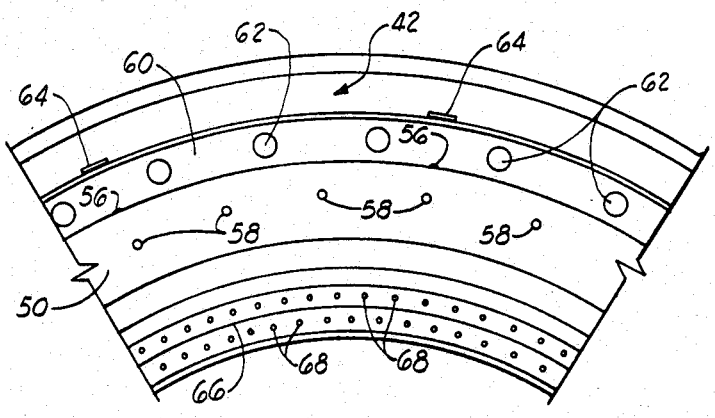
FIG. 5 is a top view of the apparatus of FIG. 4.

As best shown in FIGS. 4 and 5, the burner 50 includes a plurality of ignition orifices 56 formed in the side thereof facing the tubular member 40 and a plurality of primary fuel gas discharge orifices 58 formed in the top thereof. As will be described further hereinbelow, fuel gas is discharged by way of the ignition orifices 56 laterally of the burner 50 into an ignition zone and the fuel gas is discharged by way of the primary discharge orifices 58 from the top of the burner 50 in directions substantially in the direction of discharge of the waste gases from the first tubular member 30. Attached to the burner 50 on the side thereof containing the ignition orifices 56 at a position upstream thereof is an ignition zone shield 60. The shield 60 includes a plurality of openings 62 formed therein to allow the passage of a portion of the air therethrough, and baffles 64 are optionally attached to the periphery of the shield 60 at points opposite the ignition orifices 56 to divert fuel gas discharged from the orifices 56. The shield 60 can also optionally include slots (not shown) therein for providing air passage and allowing for thermal expansion.

Optionally attached to the first tubular member 30 at the discharge end 32 thereof is a flame retention device 66. The device 66 includes a plurality of openings 68 therein and functions to retain a waste gas ignition flame adjacent the discharge end 32 of the tubular member 30. That is, portions of the waste gases flow through the ports 68 in the device 66 which are ignited and burned adjacent the device.

As shown in FIGS. 1-3, the burner apparatus 10 preferably includes three pilot burners 70 attached at the discharge end of the apparatus for initially igniting the fuel gas discharged from the burner 50 and/or waste gas discharged from the discharge end 32 of the tubular member 30. The pilot burners 70 are connected to conduits 72 which are each connected to conduits 26 as previously described.

In operation of the apparatus 10, a stream of inert vitiated waste gases to be flared is caused to flow by way of the conduits 14 and 12 through the first tubular member 30 and to be discharged into the atmosphere by way of the discharge end 32 thereof. Simultaneously, a stream of combustion air produced by the air blower 16 flows through the conduits 18 and 44 into the discharge space 42 between the first and second tubular members 30 and 40. The diverting baffle 46 causes the air to be distributed within the discharge space 42 and then to be discharged in an annular envelope of relatively constant velocity around the waste gases discharged from the discharge end 32 of the tubular member 30. Fuel gas supplied to the burner 50 by way of the conduits 20 and 54 connected thereto is discharged therefrom by way of the ignition orifices 56 and primary discharge orifices 58 disposed therein. The portions of the fuel gas discharged by way of the ignition orifices 56 enter the ignition zone shielded by the shield 60, are initially ignited by the pilot burners 70, mix with air flowing into the ignition zone by way of the openings 62 in the shield 60 and are continuously burned in the ignition zone. The portions of the fuel gas discharged by way of the primary discharge orifices 58 are ignited by the burning gases in the ignition zone and/or the pilots 70, are mixed with combustion air flowing through the discharge space 42 and are burned in a stable envelope around the stream of waste gases discharged from the tubular member 30. The envelope of burning gases around the waste gases causes a portion of the waste gases to be heated to the ignition temperature thereof and then to be ignited and burned thereby providing heat and ignition to the remaining waste gases.

The rates of combustion air and auxiliary fuel gas discharged from the discharge space 42 of the burner apparatus 10 are adjusted whereby the fuel gas is burned efficiently and the flames produced are highly stable in windy environments.

While the apparatus 10 is particularly suitable for flaring inert vitiated waste gases, it will be understood by those skilled in the art that other waste gases including those having intermediate and high heating values can also be efficiently flared by the apparatus and in accordance with the methods of this invention.

Figure 6:
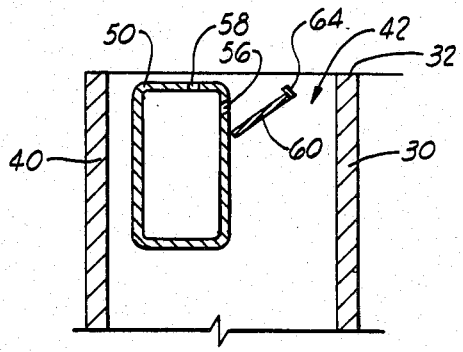
FIG. 6 is an enlarged view similar to FIG. 4, but showing an alternate form of apparatus of the invention.
Figure 7:
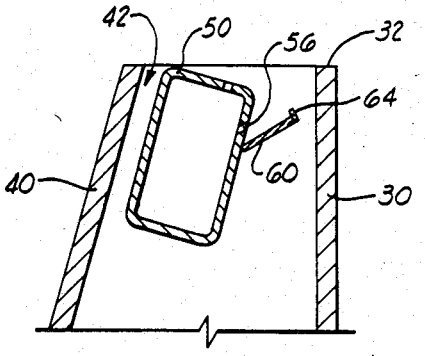
FIG. 7 is a view similar to FIG. 6 showing yet another alternate form of apparatus of the invention.
Figure 8:
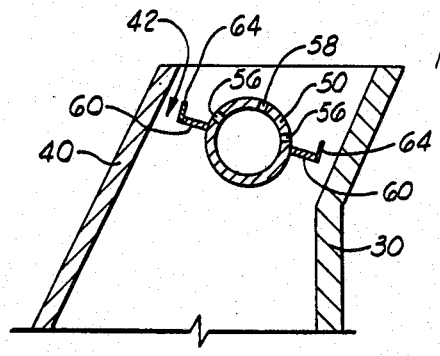
FIG. 8 is a view similar to FIG. 6 showing still another alternate form of apparatus of the invention.

Referring now to FIGS. 6, 7 and 8, various alternate arrangements of the burner 50, ignition shield 60 and discharge space 42 formed by the tubular members 30 and 40 are illustrated. As shown in FIG. 6, the ignition discharge orifices 56 in the burner 50 can be in the side thereof facing the tubular member 30 with the ignition zone shield 60 being positioned between the burner 50 and the tubular member 30. In addition, in order to direct the envelope of burning gases produced towards the waste gases discharged from the tubular member 30, the primary fuel gas discharge orifices 58 of the burner 50 can be inclined towards the discharge end 32 of the tubular member 30. In applications where it is desirable to provide extra stability to the flames produced by the flare burner, where large volumes of waste gases are being flared, or for other reason, both the air and fuel gas discharged from the discharge space 42 can be caused to flow inwardly towards the waste gases by inclining both the burner 50 and tubular member 40 inwardly as shown in FIG. 7. In another similar arrangement illustrated in FIG. 8, both the tubular member 40 and tubular member 30 are inclined inwardly at the discharge end 32 of the tubular member 30 to cause the mixture of fuel gas and air discharged from the space 42 to flow inwardly. In addition, the burner 50 is of circular cross-sectional shape and ignition orifices are provided on opposite sides thereof as are ignition shields 60.

Figure 9:
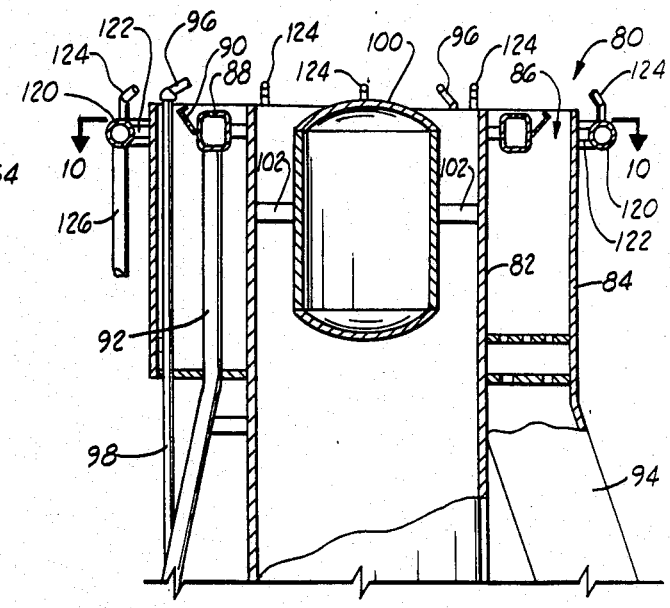
FIG. 9 is a side, partly sectional view of an alternate form of flare burner apparatus of the present invention.
Figure 10:
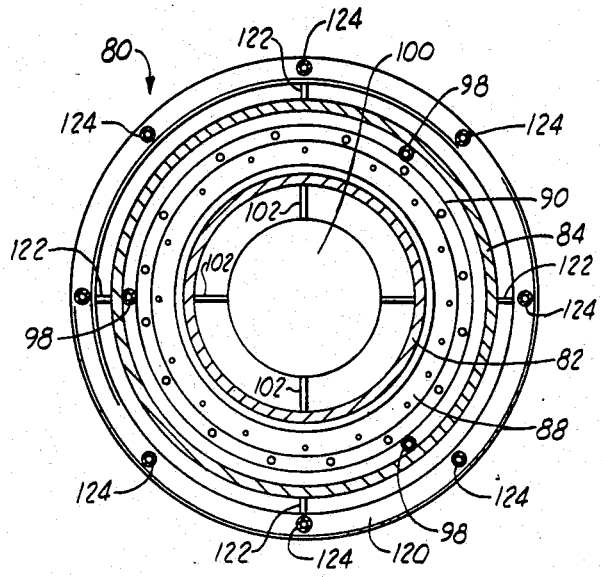
FIG. 10 is a cross-sectional view taken along line 10—10 of FIG. 9.

Referring now to FIGS. 9 and 10, an alternate form of flare burner apparatus is illustrated and generally designated by the numeral 80. The flare burner 80 is particularly suitable for flaring high flow rates of inert vitiated waste gases and is identical to the flare burner apparatus 10 previously described except it includes a baffle member disposed within the discharge end portion of the first tubular member and an optional fuel gas injector ring disposed externally of the discharge end of the second tubular member. More specifically, the flare burner 80 includes a first tubular member 82 for discharging waste gases and a second tubular member 84 positioned around at least the discharge end portion of the first tubular member whereby a discharge space 86 is provided therebetween. A burner 88 and ignition zone shield 90 are disposed in the discharge space 86, the burner 88 being connected to a source of fuel gas by a conduit 92. A conduit 94 is sealingly connected to the discharge space 86 and to a source of combustion air and pilot burners 96 are provided connected to sources of fuel and air mixtures by conduits 98 disposed within the tubular member 84. Located within the discharge end portion of the tubular member 82 and positioned coaxially therewith is a preferably cylindrical baffle member 100 which is substantially closed at both ends. The cylindrical member 100 is attached within the tubular member 82 by a plurality of lugs 102 and functions to annularize the waste gases discharged. The annularization of the waste gases brings the waste gases closer to the envelope of burning auxiliary fuel gas thereby increasing the exposure of the waste gases to the fuel gas being burned and accelerating their ignition and burning. Optionally, in order to provide additional fuel gas for mixing with air and burning in the envelope of burning gases surrounding the discharged waste gases, a fuel gas injector ring 120 is optionally located externally of the discharge end of the tubular member 84 and attached thereto by lugs 122. A plurality of upstanding fuel injector nozzles 124 or equivalent orifice means are connected to the ring 120, and the ring 120 is connected to a conduit 126 which is in turn connected to a source of fuel gas. As shown in FIG. 9, the fuel injector nozzles 124 are preferably inclined towards the interior of the flare apparatus 80 so that fuel gas discharged from the nozzles 124 is injected into the envelope of burning fuel gas and air adjacent the discharge end of the apparatus 80.

Figure 11:
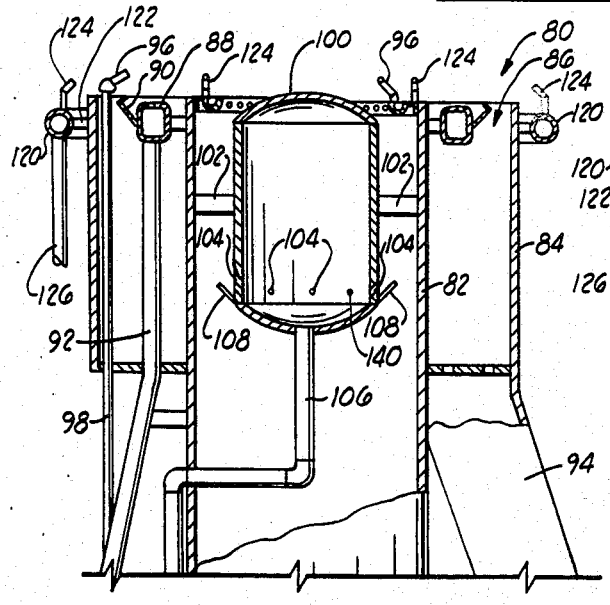
FIG. 11 is a side partly sectional view similar to FIG. 9 showing yet another alternate form of flare burner apparatus of the invention.

If the high flow rate and/or burning properties of the waste gases require even more heating, additional auxiliary fuel gas can be combined with the waste gases. It has been found that when auxiliary fuel gas is combined with the waste gases, the burning of the waste gases is accelerated if the auxiliary fuel is introduced into the flowing waste gases in a ring or annular pattern. As shown in FIG. 11, this can be accomplished in the apparatus 80 by providing a plurality of discharge orifices 104 in the sides of the closed cylindrical baffle member 100 and connecting the interior of the member 100 to a source of fuel gas by a conduit 106 sealingly attached thereto. To prevent the fuel gas from being immediately dispersed in the waste gases and to promote the burning thereof in an annular pattern within the waste gases, shields 108 can be utilized adjacent the orifices 104.

Figure 12:
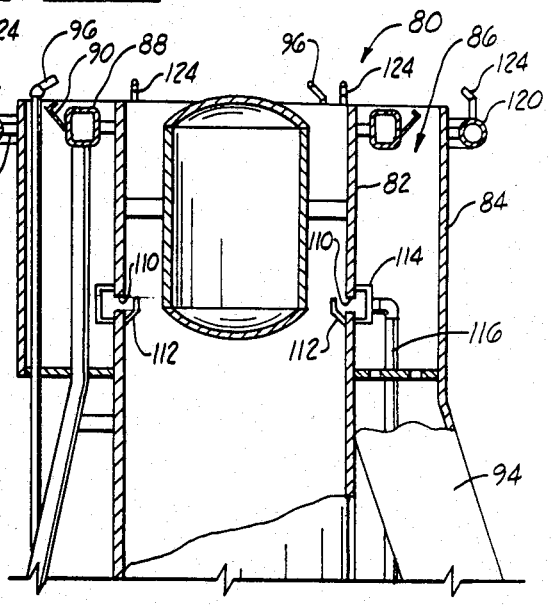
FIG. 12 is a side, partly sectional view similar to FIG. 9 showing still another alternate form of flare burner apparatus of the present invention.

An alternate arrangement for combining additional auxiliary fuel with the waste gases is shown in FIG. 12. In this arrangement, a plurality of fuel gas discharge orifices 110 are disposed in the sides of the first tubular member 82 shielded by shields 112. A fuel gas bustle is attached over the orifices 110 within the discharge space 86 and the bustle is connected by a conduit 116 to a source of fuel gas.

In order to further illustrate the present invention and facilitate a clear understanding of the method and flare gas burner apparatus of the present invention, the following example is given.

EXAMPLE

A flare burner apparatus 10 is attached to a 16-inch by 10-feet feet high conduit which conducts inert vitiated waste gases at a rate of 90,000 SCF/HR. and at a temperature of $-10°$ F. to the burner. The first tubular member 30 of the apparatus 10 is about 16 inches in diameter and the second tubular member 40 is about 22 inches in diameter. The burner 50 is formed of $1\times2$ inch rectangular tubing and includes 15 ignition orifices 56 and 30 primary discharge orifices 58.

The waste gases have a heating value of about 190 BTU/SCF. About 30,000 SCF/HR. of combustion air is supplied to and discharged from the discharge space 42 of the burner 10 and 2,000 SCF/HR. of natural gas is conducted to the burner 50 and discharged therefrom. The natural gas is burned in a stable envelope of burning gases around the waste gases and a portion of the waste gases are heated to ignition temperature, ignited and efficiently burned thereby providing heat and ignition to the remaining waste gases.

Thus, the present invention is well adapted to carry out the objects and attain the ends and advantages mentioned as well as those inherent therein. While presently preferred embodiments of the invention have been described for purposes of this disclosure, numerous changes in the arrangement and construction of parts will suggest themselves to those skilled in the art, which changes are encompassed within the spirit of this invention as defined by the appended claims.

What is claimed is:

1. Burner apparatus for flaring waste gases comprising:

a first tubular member for discharging waste gases having an inlet end and a discharge end;

a second tubular member positioned around at least the discharge end portion of said first tubular member whereby a discharge space is provided between said first and second tubular members around and adjacent said discharge end of said first tubular member;

burner means disposed within said discharge space for discharging and igniting fuel gas therein, said burner means comprising:

a conduit disposed in said discharge space in a plane substantially parallel with the plane of said discharge end of said first tubular member, said conduit including a plurality of fuel gas discharge orifices disposed therein, said fuel gas discharge orifices comprising ignition orifices for discharging fuel gas into an ignition zone adjacent said conduit and primary discharge orifices for discharging fuel gas in directions substantially in the direction of discharge of said waste gases from said first tubular member; and an ignition zone shield positioned adjacent said conduit;

flame retention means attached to said discharge end of said first tubular member;

fuel gas conduit means sealingly connected to said burner means for connecting said burner means to a source of fuel gas; and combustion air conduit means sealingly connected to said discharge space for connecting said space to a source of combustion air whereby combustion air supplied to said discharge space is mixed with fuel gas supplied to and discharged from said burner means, said mixture is ignited and discharged from said discharge space and burned in a stable envelope around waste gases discharged from said first tubular member, and a portion of said waste gases are heated to the ignition temperature thereof, ignited and burned thereby providing heat and ignition to the remaining waste gases.

2. Burner apparatus for flaring waste gases comprising:

a first tubular member for discharging waste gases having an inlet end and a discharge end;

a second tubular member positioned around at least the discharge end portion of said first tubular member whereby a discharge space is provided between said first and second tubular members around and adjacent said discharge end of said first tubular member;

a baffle member disposed within said discharge end of said first tubular member to annularize the waste gases discharged from said tubular member;

burner means disposed within said discharge space for discharging and igniting fuel gas therein;

fuel gas conduit means sealingly connected to said burner means for connecting said burner means to a source of fuel gas; and combustion air conduit means sealingly connected to said discharge space for connecting said space to a source of combustion air whereby combustion air supplied to said discharge space is mixed with fuel gas supplied to and discharged from said burner means, said mixture is ignited and discharged from said discharge space and burned in a stable envelope around waste gases discharged from said first tubular member, and a portion of said waste gases are heated to the ignition temperature thereof, ignited and burned thereby providing heat and ignition to the remaining waste gases.

3. Burner apparatus for flaring waste gases comprising:

a first tubular member for discharging waste gases having an inlet end and a discharge end;

a second tubular member positioned around at least the discharge end portion of said first tubular member whereby a discharge space is provided between said first and second tubular members around and adjacent said discharge end of said first tubular member;

burner means disposed within said discharge space for discharging and igniting fuel gas therein;

fuel gas conduit means sealingly connected to said burner means for connecting said burner means to a source of fuel gas;

combustion air conduit means sealingly connected to said discharge space for connecting said space to a source of combustion air whereby combustion air supplied to said discharge space is mixed with fuel gas supplied to and discharged from said burner means, and said mixture is ignited and discharged from said discharge space and burned in a stable envelope around waste gases discharged from said first tubular member;

at least one fuel injector nozzle connected to a source of fuel gas positioned adjacent said second tubular member for injecting additional fuel gas into said annular envelope of burning fuel gas and air, whereby a portion of said waste gases are heated to the ignition temperature thereof, ignited and burned thereby providing heat and ignition to the remaining waste gases.

4. A flare burner for burning waste gases comprising:

a first cylindrical member for conducting and discharging waste gases into the atmosphere having an inlet end adapted for connection to a waste gas conduit and a discharge end;

a second cylindrical member positioned around at least the discharge end portion of said first cylindrical member whereby an annular discharge space is provided between said first and second cylindrical members around and adjacent said discharge end of said first cylindrical member;

burner means disposed within said discharge space for discharging and igniting fuel gas therein, said burner means comprising an annular conduit disposed in said annular discharge space in a plane substantially parallel with the plane of said discharge end of said first cylindrical member, said annular conduit including a plurality of fuel gas discharge orifices disposed therein, said fuel gas discharge orifices comprising ignition orifices for discharging fuel gas substantially laterally into an ignition zone adjacent said annular conduit and primary discharge orifices for discharging fuel gas in directions substantially in the direction of discharge of said waste gases from said first cylindrical member;

fuel gas conduit means sealingly connected to said burner means for conducting fuel gas to said burner means from a source thereof; and combustion air conduit means sealingly connected to said annular discharge space for conducting combustion air thereto from a source thereof whereby combustion air is mixed with fuel gas discharged from said burner means, said mixture is ignited and discharged from said annular discharge space and burned in a stable annular envelope around waste gases discharged from said first cylindrical member, and a portion of said waste gases are heated to the ignition temperature thereof, ignited and burned thereby providing heat and ignition to the remaining waste gases.

5. The apparatus of claim 4 wherein said burner means are further characterized to include a perforated annular ignition zone shield positioned adjacent said annular conduit upstream of said ignition orifices therein.

6. A flare burner for burning waste gases comprising:

a first cylindrical member for conducting said discharging waste gases into the atmosphere having an inlet end adapted for connection to a waste gas conduit and a discharge end;

a second cylindrical member positioned around at least the discharge end portion of said first cylindrical member whereby an annular discharge space is provided between said first and second cylindrical members around and adjacent said discharge end of said first cylindrical member;

burner means disposed within said discharge space for discharging and igniting fuel gas therein;

flame retention means attached to said discharge end of said first cylindrical member;

fuel gas conduit means sealingly connected to said burner means for conducting fuel gas to said burner means from a source thereof; and combustion air conduit means sealingly connected to said annular discharge space for conducting combustion air thereto from a source thereof whereby combustion air is mixed with fuel gas discharged from said burner means, said mixture is ignited and discharged from said annular discharge space and burned in a stable annular envelope around waste gases discharged from said first cylindrical member, and a portion of said waste gases are heated to the ignition temperature thereof, ignited and burned thereby providing heat and ignition to the remaining waste gases.

7. A flare burner for burning waste gases comprising:

a first cylindrical member for conducting and discharging waste gases into the atmosphere having an inlet end adapted for connection to a waste gas conduit and a discharge end;

a second cylindical member positioned around at least the discharge end portion of said first cylindrical member whereby an annular discharge space is provided between said first and second cylindrical members around and adjacent said discharge end of said first cylindrical member;

a circular baffle member disposed centrally within said discharge end of said first cylindrical member to annularize said waste gases discharged from said first cylindrical member;

burner means disposed within said discharge space for discharging and igniting fuel gas therein;

fuel gas conduit means sealingly connected to said burner means for conducting fuel gas to said burner means from a source thereof; and combustion air conduit means sealingly connected to said annular discharge space for conducting combustion air thereto from a source thereof whereby combustion air is mixed with fuel gas discharged from said burner means, said mixture is ignited and discharged from said annular discharge space and burned in a stable annular envelope around waste gases discharged from said first cylindrical member, and a portion of said waste gases are heated to the ignition temperature thereof, ignited and burned thereby providing heat and ignition to the remaining waste gases.

8. The apparatus of claim 7 wherein said baffle is comprised of a cylindrical member substantially closed at both ends positioned coaxially with said first cylindrical member.

9. The apparatus of claim 8 which is further characterized to include:

said substantially closed cylindrical member including at least one fuel gas discharge orifice disposed therein for discharging fuel gas into said waste gases; and conduit means sealingly connected to said substantially closed cylindrical member for connecting the interior of said member to a source of fuel gas.

10. A method of flaring waste gases comprising the steps of:

discharging said waste gases into the atmosphere;

discharging combustion air into the atmosphere in an envelope around said waste gases;

discharging and igniting fuel gas within said envelope of combustion air so that said fuel gas mixes with and is burned in said combustion air and a stable envelope of burning gases is formed around said waste gases; and forming said waste gases into annular shape in cross-section within and adjacent to said annular envelope of burning gases whereby a portion of said waste gases are heated to ignition temperature thereof, ignited and burned thereby providing heat and ignition to the remaining waste gases.

11. The method of claim 10 which is further characterized to include the step of discharging additional fuel gas in an annular pattern within said waste gases whereby said fuel gas is ignited by said envelope of burning gases, mixes with air and burns downstream of said envelope to facilitate the heating, igniting and burning of said waste gases.

* * * * *